US011024229B2

(12) United States Patent
Zhang

(10) Patent No.: US 11,024,229 B2
(45) Date of Patent: Jun. 1, 2021

(54) DISPLAY PANEL AND DETECTION METHOD THEREOF, AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Xuru Zhang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 7 days.

(21) Appl. No.: 16/525,711

(22) Filed: Jul. 30, 2019

(65) Prior Publication Data

US 2020/0135112 A1 Apr. 30, 2020

(30) Foreign Application Priority Data

Oct. 30, 2018 (CN) ..... 201811276673.4

(51) Int. Cl.
*G09G 3/3258* (2016.01)

(52) U.S. Cl.
CPC ..... *G09G 3/3258* (2013.01); *G09G 2330/028* (2013.01)

(58) Field of Classification Search
CPC ..... G09G 3/3258; G09G 2330/028
See application file for complete search history.

(56) References Cited

U.S. PATENT DOCUMENTS 8,605,031 B2 12/2013 Wu
8,803,869 B2 * 8/2014 Kato ..... G09G 3/3225 345/212
8,952,952 B2 2/2015 Ebisuno et al.
8,952,953 B2 2/2015 Ebisuno et al.
(Continued)

FOREIGN PATENT DOCUMENTS

CN 101488323 7/2009
CN 102959611 3/2013
CN 102971779 3/2013
CN 102971780 3/2013
(Continued)

OTHER PUBLICATIONS

Chinese Office Action dated Feb. 5, 2020 corresponding to Chinese Application No. 201811276673.4 18 pages.

*Primary Examiner* — Amare Mengistu
*Assistant Examiner* — Crystal Mathews
(74) *Attorney, Agent, or Firm* — Leason Ellis LLP

(57) ABSTRACT

A display panel, a detection method thereof and a display device are provided. The display panel includes a sub-pixel and a detection circuit, the sub-pixel includes a pixel circuit and a light-emitting element, the pixel circuit is configured to drive the light-emitting element to emit light; the detection circuit includes a detection signal terminal and a control voltage terminal, a first electrode of the light-emitting element is connected to the detection signal terminal, and a second electrode of the light-emitting element is connected to the control voltage terminal; and the detection circuit is configured to output a variable voltage through the control voltage terminal, the variable voltage includes a first sub-voltage signal, and the detection circuit is further configured to detect an electrical parameter at the first electrode of the light-emitting element in a case where the first sub-voltage signal is applied to the second electrode of the light-emitting element.

19 Claims, 4 Drawing Sheets

(56) References Cited

U.S. PATENT DOCUMENTS

| | | | | |
|---|---|---|---|---|
| 9,185,751 | B2 | 11/2015 | Ebisuno et al. | |
| 9,218,772 | B2 | 12/2015 | Kim | |
| 9,940,878 | B2 | 4/2018 | Liang | |
| 9,966,042 | B2 | 5/2018 | Deng | |
| 10,008,159 | B2 * | 6/2018 | Song | G09G 3/3241 |
| 2013/0016091 | A1 * | 1/2013 | Kato | G09G 3/3233<br>345/419 |
| 2013/0050292 | A1 * | 2/2013 | Mizukoshi | G09G 3/3291<br>345/690 |
| 2013/0321254 | A1 | 12/2013 | Kim | |
| 2017/0169767 | A1 | 6/2017 | Song | |
| 2018/0082619 | A1 * | 3/2018 | Fu | G09G 3/3258 |

FOREIGN PATENT DOCUMENTS

| | | | |
|---|---|---|---|
| CN | 102971782 | | 3/2013 |
| CN | 103050095 | | 4/2013 |
| CN | 103456275 | | 12/2013 |
| CN | 103903571 | | 7/2014 |
| CN | 104809986 | A | 7/2015 |
| CN | 105047137 | A | 11/2015 |
| CN | 104809986 | B | 5/2016 |
| CN | 105575326 | A | 5/2016 |
| CN | 205541822 | | 8/2016 |
| CN | 106782361 | | 5/2017 |
| CN | 207425322 | | 5/2018 |
| CN | 108538247 | | 9/2018 |
| EP | 2126883 | B1 | 1/2012 |
| EP | 2160728 | B1 | 1/2013 |
| EP | 2351012 | B1 | 9/2015 |
| TW | 201216248 | | 4/2012 |
| WO | 2013127188 | A1 | 6/2013 |

* cited by examiner

DISPLAY PANEL AND DETECTION METHOD THEREOF, AND DISPLAY DEVICE

CROSS-REFERENCE TO RELATED APPLICATION

The present application claims priority of Chinese Patent Application No. 201811276673.4, filed on Oct. 30, 2018, the disclosure of which is incorporated herein by reference in its entirety as part of the present application.

TECHNICAL FIELD

Embodiments of the present disclosure relate to a display panel and a detection method thereof, and a display device.

BACKGROUND

In fields of display technologies, compared with liquid crystal display (LCD) panels, organic light-emitting diode (OLED) display panels have characteristics, such as self-luminescence, high contrast, low energy consumption, wide viewing angle, fast response speed, used for a flexible panel, wide operation temperature range, simple manufacturing process, etc. Therefore, the OLED display panels have broad development prospects, and the OLED display panels gradually replace the liquid crystal display panels and become a new generation display mode.

SUMMARY

At least one embodiment of the present disclosure provides a display panel, which includes a sub-pixel and a detection circuit; the sub-pixel includes a pixel circuit and a light-emitting element, and the pixel circuit is connected to the light-emitting element and is configured to drive the light-emitting element to emit light; the detection circuit includes a detection signal terminal and a control voltage terminal, a first electrode of the light-emitting element is connected to the detection signal terminal, and a second electrode of the light-emitting element is connected to the control voltage terminal; and the detection circuit is configured to output a variable voltage, through the control voltage terminal, to the second electrode of the light-emitting element, the variable voltage includes a first sub-voltage signal, and the detection circuit is further configured to detect an electrical parameter at the first electrode of the light-emitting element in a case where the first sub-voltage signal is applied to the second electrode of the light-emitting element.

For example, in the display panel provided by at least one embodiment of the present disclosure, the variable voltage further comprises a second sub-voltage signal, a level of the first sub-voltage signal is different from a level of the second sub-voltage signal, and the detection circuit is further configured to apply the second sub-voltage signal to the second electrode of the light-emitting element such that the light-emitting element is capable of being driven to emit light.

For example, in the display panel provided by at least one embodiment of the present disclosure, the detection circuit includes a first sub-circuit and a second sub-circuit; a first terminal of the first sub-circuit, as the detection signal terminal, is connected to the first electrode of the light-emitting element, a second terminal of the first sub-circuit is connected to the second sub-circuit, a control terminal of the first sub-circuit is configured to receive a switch control signal, and the first sub-circuit is configured to disconnect or connect the second sub-circuit and the first electrode of the light-emitting element under control of the switch control signal; and the second sub-circuit is configured to detect the electrical parameter.

For example, in the display panel provided by at least one embodiment of the present disclosure, the control voltage terminal is further connected to the control terminal of the first sub-circuit to transmit the variable voltage to the control terminal of the first sub-circuit, and the variable voltage serves as the switch control signal.

For example, in the display panel provided by at least one embodiment of the present disclosure, the first sub-circuit comprises a switch element, the first terminal of the first sub-circuit serves as an input terminal of the switch element, the second terminal of the first sub-circuit serves as an output terminal of the switch element, and the control terminal of the first sub-circuit serves as a control terminal of the switch element.

For example, in the display panel provided by at least one embodiment of the present disclosure, the detection circuit further comprises a control sub-circuit, an output terminal of the control sub-circuit serves as the control voltage terminal, and the control sub-circuit is configured to generate and output the variable voltage.

For example, the display panel provided by at least one embodiment of the present disclosure further includes an array substrate and a drive chip; the drive chip is bonded to the array substrate through a flexible circuit board, the array substrate comprises the sub-pixel, and the drive chip comprises the detection circuit.

For example, the display panel provided by at least one embodiment of the present disclosure further includes a compensation circuit, the detection circuit is configured to detect a plurality of electrical parameters at the first electrode of the light-emitting element; and the compensation circuit is configured to calculate to obtain a compensated data voltage based on an initial data voltage according to the plurality of electrical parameters, and the compensated data voltage serves as a display data voltage for the sub-pixel to perform a display operation.

For example, in the display panel provided by at least one embodiment of the present disclosure, the compensation circuit includes a calculation module and a first storage sub-circuit; the calculation module is configured to acquire a plurality of detection data voltages, which are in one-to-one correspondence to the plurality of electrical parameters, for the sub-pixel, calculate a characteristic parameter of the pixel circuit according to the plurality of electrical parameters and the plurality of detection data voltages, and calculate the compensated data voltage based on the initial data voltage according to the characteristic parameter; and the first storage sub-circuit is configured to store the characteristic parameter.

For example, in the display panel provided by at least one embodiment of the present disclosure, the compensation circuit includes a calculation module and a first storage sub-circuit; the calculation module is configured to acquire a plurality of detection data voltages, which are in one-to-one correspondence to the plurality of electrical parameters, for the sub-pixel, calculate a characteristic parameter of the pixel circuit according to the plurality of electrical parameters and the plurality of detection data voltages, calculate to obtain a plurality of standard compensation data voltages, which are in one-to-one correspondence to all gray scale levels of the sub-pixel, according to the characteristic parameter, and acquire the compensated data voltage corresponding to the initial data voltage based on the plurality of standard compensation data voltages; and the first storage sub-circuit is configured to store the plurality of standard compensation data voltages.

For example, in the display panel provided by at least one embodiment of the present disclosure, the pixel circuit includes a drive sub-circuit, a data writing sub-circuit, and a second storage sub-circuit, the data writing sub-circuit is configured to write a display data voltage that is received into the second storage sub-circuit under control of a scan signal; the second storage sub-circuit is configured to store the display data voltage and maintain the display data voltage at a control terminal of the drive sub-circuit; and the drive sub-circuit is configured to drive the light-emitting element to emit light under control of the display data voltage in a case where the second sub-voltage signal is applied to the second electrode of the light-emitting element.

For example, in the display panel provided by at least one embodiment of the present disclosure, the drive sub-circuit includes a drive transistor, the data writing sub-circuit includes a data writing transistor, the second storage sub-circuit includes a storage capacitor; a first electrode of the drive transistor is electrically connected to a power supply, a second electrode of the drive transistor is electrically connected to the first electrode of the light-emitting element, a gate electrode of the drive transistor is electrically connected to a second electrode of the data writing transistor and a first terminal of the storage capacitor, a first electrode of the data writing transistor is configured to receive the display data voltage, a gate electrode of the data writing transistor is configured to receive the scan signal, and a second terminal of the storage capacitor is electrically connected to the power supply.

For example, in the display panel provided by at least one embodiment of the present disclosure, the electrical parameter comprises a current at the first electrode of the light-emitting element.

At least one embodiment of the present disclosure also provides a display panel, which includes a sub-pixel and a detection circuit; the sub-pixel comprises a pixel circuit and a light-emitting element, the pixel circuit comprises a drive transistor, a data writing transistor, and a storage capacitor, the detection circuit comprises a first sub-circuit and a second sub-circuit, and the first sub-circuit comprises a switch element; a first electrode of the drive transistor is electrically connected to a power supply, a second electrode of the drive transistor is electrically connected to a first electrode of the light-emitting element, a gate electrode of the drive transistor is electrically connected to a second electrode of the data writing transistor and a first terminal of the storage capacitor, a first electrode of the data writing transistor is configured to receive a display data voltage, a gate electrode of the data writing transistor is configured to receive a scan signal, and a second terminal of the storage capacitor is electrically connected to the power supply; a second electrode of the light-emitting element is configured to receive a variable voltage, and the variable voltage comprises a first sub-voltage signal; an input terminal of the switch element is connected to the first electrode of the light-emitting element, an output terminal of the switch element is connected to the second sub-circuit, a control terminal of the switch element is configured to receive the variable voltage, and the switch element is turned on in a case where the first sub-voltage signal is applied to the control terminal of the switch element; and the second sub-circuit is configured to detect an electrical parameter at the first electrode of the light-emitting element in a case where the first sub-voltage signal is applied to the second electrode of the light-emitting element.

For example, in the display panel provided by at least one embodiment of the present disclosure, the variable voltage further comprises a second sub-voltage signal, a level of the first sub-voltage signal is different from a level of the second sub-voltage signal, and the drive transistor drives the light-emitting element to emit light in a case where the second sub-voltage signal is applied to the second electrode of the light-emitting element.

At least one embodiment of the present disclosure also provides a display device including the display panel provided by any one of the embodiments of the present disclosure.

At least one embodiment of the present disclosure also provides a detection method applied to the display panel provided by any one of the embodiments of the present disclosure, and the detection method includes: controlling a state of the light-emitting element by the first sub-voltage signal of the variable voltage and detecting a plurality of electrical parameters of the first electrode of the light-emitting element.

For example, in the detection method provided by at least one embodiment of the present disclosure, controlling the state of the light-emitting element by the first sub-voltage signal of the variable voltage and detecting the plurality of electrical parameters of the first electrode of the light-emitting element includes: controlling the light-emitting element to be in a turn-off state by the first sub-voltage signal to detect the plurality of electrical parameters acquired by the first electrode of the light-emitting element.

For example, in the detection method provided by at least one embodiment of the present disclosure, the pixel circuit includes a drive sub-circuit, and the detection method further includes: acquiring a plurality of detection data voltages, which are in one-to-one correspondence to the plurality of electrical parameters, for the sub-pixel; and calculating to obtain a characteristic parameter of the drive sub-circuit according to the plurality of electrical parameters and the plurality of detection data voltages.

For example, the detection method provided by at least one embodiment of the present disclosure further includes: calculating to obtain a plurality of standard compensation data voltages, which are in one-to-one correspondence to all gray scale levels of the sub-pixel, according to the characteristic parameter.

For example, in the detection method provided by at least one embodiment of the present disclosure, calculating to obtain a plurality of standard compensation data voltages, which are in one-to-one correspondence to all gray scale levels of the sub-pixel, according to the characteristic parameter includes: selecting a plurality of reference gray scale levels; calculating a plurality of reference light-emitting currents, which are in one-to-one correspondence to the plurality of reference gray scale levels, based on a corresponding relation between a current of the light-emitting element and a brightness of the light-emitting element; calculating a plurality of reference compensation data voltages, which are in one-to-one correspondence to the plurality of reference gray scale levels, according to the characteristic parameter and the plurality of reference light-emitting currents; and calculating a plurality of standard compensation data voltages, which are in one-to-one correspondence to the all gray scale levels, according to the plurality of reference compensation data voltages.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
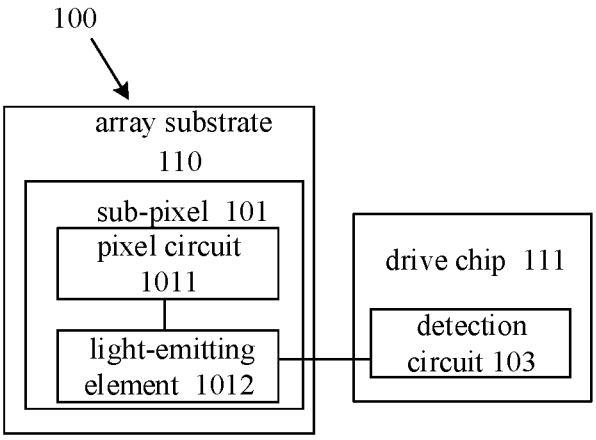
FIG. 1A shows a schematic block diagram of a display panel provided by at least one embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In order to keep the following description of embodiments of the present disclosure clear and concise, detailed descriptions of known functions and known components are omitted in the embodiments of the present disclosure.

In an OLED display panel, a light-emitting brightness of an OLED which serves as a light-emitting element is proportional to a drive current applied to the light-emitting element, and the drive current may be determined by a data voltage applied to a drive transistor in a pixel circuit and a system voltage. Due to reasons such as limitations of the manufacturing process, uneven growth of low-temperature polysilicon materials with high mobility and the like, characteristic parameters, such as a threshold voltage, mobility of carriers, series resistance and the like, of respective drive transistors in the OLED display panel are inconsistent, thus causing drive currents flowing through the respective drive transistors to be different from each other under the same data voltage, resulting in uneven brightness of the OLED display panel and affecting display qualities.

At least one embodiment of the present disclosure provides a display panel, a display device and a detection method of the display panel. In a detection process, a state of the light-emitting element is controlled through a variable voltage to detect an electrical parameter of the light-emitting element, and a characteristic parameter of the drive transistor can be determined according to the electrical parameter of the light-emitting element. In a display process, data voltages of respective gray scales can be compensated according to the characteristic parameter of the drive transistor, thereby improving the uniformity of the display panel. On the other hand, in the display panel, only one signal detection line is added in a pixel circuit, so as to achieve to detect the electrical parameter of the light-emitting element, thus reducing the process complexity and solving a problem that a space of the pixel circuit under high resolution is limited.

For example, according to characteristics of transistors, the transistors can be divided into N-type transistors and P-type transistors. In embodiments of the present disclosure, the drive transistor and a data writing transistor can be N-type transistors (e.g., N-type MOS transistors). However, the embodiments of the present disclosure is not limited to this case. The drive transistor and the data writing transistor can also be P-type transistors (e.g., P-type MOS transistors). Those skilled in the art can specifically set types of various transistors in the present disclosure according to actual needs.

It should be noted that the transistors used in the embodiments of the present disclosure may be thin film transistors or field effect transistors, or other switch devices with the same characteristics, and the thin film transistors may include oxide thin film transistors, amorphous silicon thin film transistors, or polysilicon thin film transistors, etc. A source electrode and a drain electrode of the transistor can be symmetrical in structure, so the source electrode and the drain electrode of the transistor can be indistinguishable in physical structure. In the embodiments of the present disclosure, in order to distinguish two electrodes of the transistor except a gate electrode which serves as a control electrode, one of the two electrodes is referred to as a first electrode described directly, and the other of the two electrodes is referred to as a second electrode, so first electrodes and second electrodes of all or part of the transistors in the embodiment of the present disclosure can be interchanged as required. For example, for an N-type transistor, a first electrode of the N-type transistor can be a source electrode, and a second electrode of the N-type transistor can be a drain electrode; for a P-type transistor, a first electrode of the P-type transistor can be a drain electrode, and a second electrode of the P-type transistor can be a source electrode. For different types of transistors, levels of control voltages of gate electrodes are also different. For example, for an N-type transistor, in a case where a control signal is at a high level, the N-type transistor is in a turn-on state; and in a case where the control signal is at a low level, the N-type transistor is in a turn-off state. For a P-type transistor, in a case where the control voltage is at a low level, the P-type transistor is in a turn-on state; and in a case where the control signal is at a high level, the P-type transistor is in a turn-off state.

Embodiments of the present disclosure will be described in detail below with reference to the accompanying drawings, but the present disclosure is not limited to these specific embodiments.

Figure 1B:
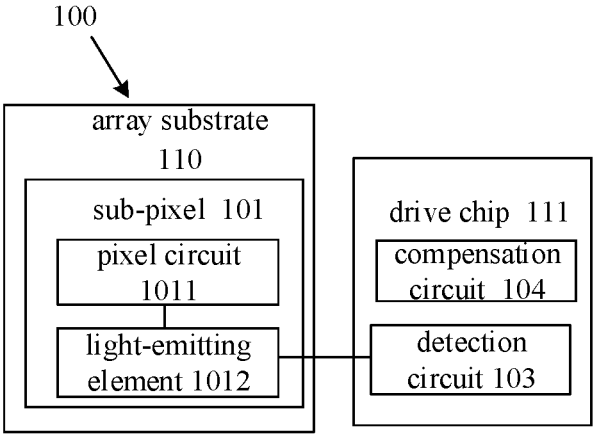
FIG. 1B shows a schematic block diagram of another display panel provided by at least one embodiment of the present disclosure.
Figure 2A:
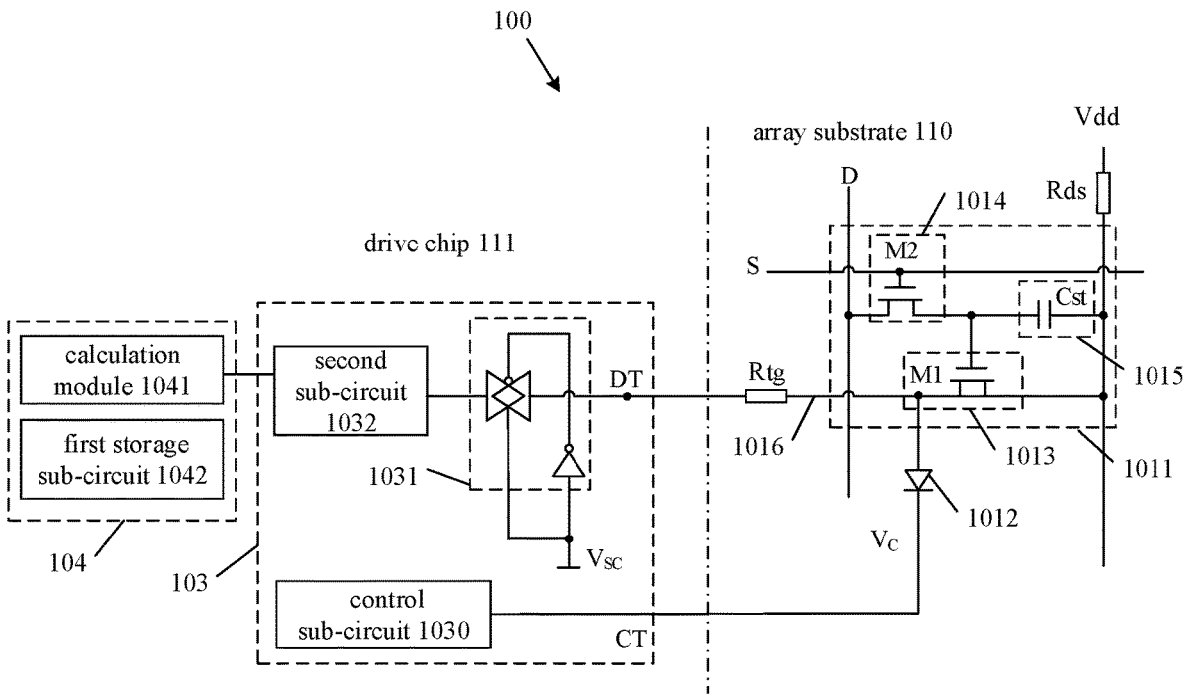
FIG. 2A shows a schematic diagram of a circuit structure of a display panel provided by at least one embodiment of the present disclosure.
Figure 2B:
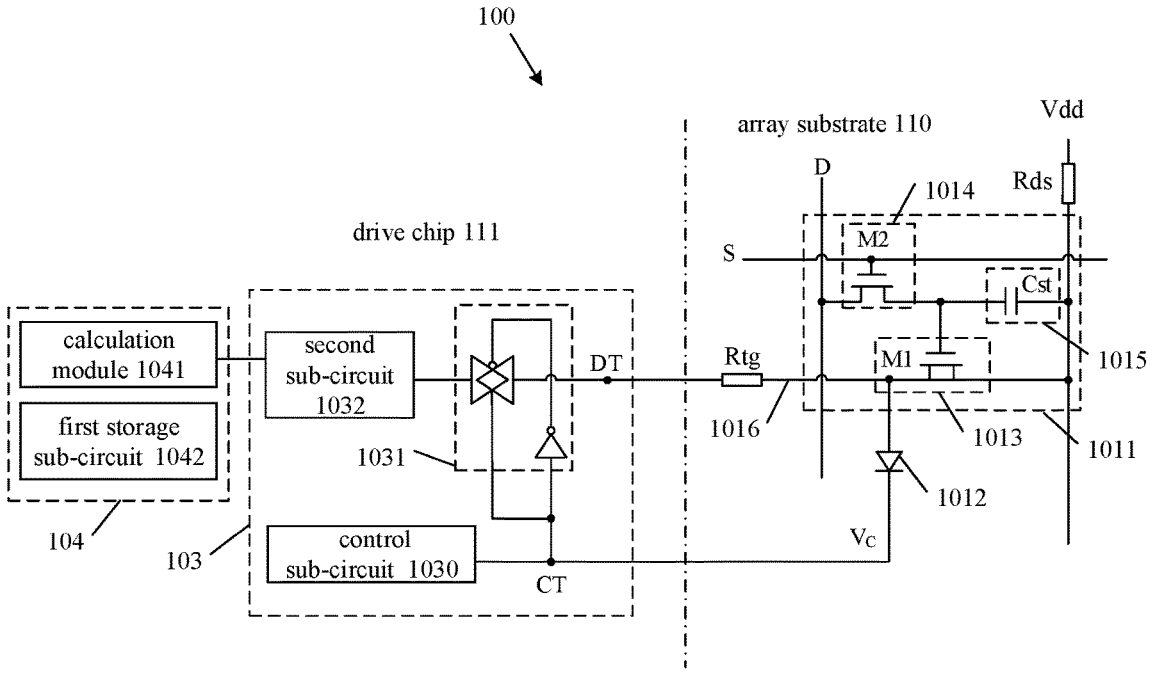
FIG. 2B shows a schematic diagram of a circuit structure of another display panel provided by at least one embodiment of the present disclosure.

FIG. 1A shows a schematic block diagram of a display panel provided by at least one embodiment of the present disclosure, FIG. 1B shows a schematic block diagram of another display panel provided by at least one embodiment of the present disclosure, FIG. 2A shows a schematic diagram of a circuit structure of a display panel provided by at least one embodiment of the present disclosure, and FIG. 2B shows a schematic diagram of a circuit structure of another display panel provided by at least one embodiment of the present disclosure.

For example, as shown in FIG. 1A and FIG. 1B, a display panel 100 includes a plurality of sub-pixels 101 and a detection circuit 103. Each of the plurality of sub-pixels 101 may include a pixel circuit 1011 and a light-emitting element 1012, in each of the plurality of sub-pixels 101, the pixel circuit 1011 is connected to the light-emitting element 1012 and is configured to drive the light-emitting element 1012 to emit light.

For example, as shown in FIG. 2A and FIG. 2B, the detection circuit 103 may include a control voltage terminal CT, a second electrode of the light-emitting element 1012 is connected to the control voltage terminal CT, the detection circuit 103 is configured to output a variable voltage Vc, through the control voltage terminal CT, to the second electrode of the light-emitting element 1012, and a voltage value of the variable voltage Vc may be set as required and not fixed at a certain potential.

For example, as shown in FIG. 2A and FIG. 2B, the detection circuit 103 may include a control sub-circuit 1030, and the control sub-circuit 1030 is connected to the control voltage terminal CT. For example, an output terminal of the control sub-circuit 1030 may serve as the control voltage terminal CT, and the control sub-circuit 1030 is configured to generate the variable voltage Vc, output the variable voltage Vc to the control voltage terminal CT, and then output the variable voltage Vc through the control voltage terminal CT to the second electrode of the light-emitting element 1012 to control a state of the light-emitting element 1012 through the variable voltage Vc.

For example, as shown in FIG. 2A and FIG. 2B, the detection circuit 103 may further include a detection signal terminal DT, a first electrode of the light-emitting element 1012 is connected to the detection signal terminal DT, and the detection circuit 103 is configured to detect an electrical parameter at the first electrode of the light-emitting element 1012 in a case where the variable voltage Vc is applied to the second electrode of the light-emitting element 1012. For example, the detection circuit 103 is configured to detect the electrical parameter at the first electrode of the light-emitting element 1012 in a case where the second electrode of the light-emitting element 1012 receives the variable voltage Vc and is in a turn-off state.

For example, the electrical parameter at the first electrode of the light-emitting element 1012 may include a current at the first electrode of the light-emitting element 1012, such as a value of the current.

For example, different states of the variable voltage Vc may include a first sub-voltage signal and a second sub-voltage signal. A level of the first sub-voltage signal is different from a level of the second sub-voltage signal. The first sub-voltage signal may be a high level signal and the second sub-voltage signal may be a low level signal, i.e. the first sub-voltage signal has a high level while the second sub-voltage signal has a low level. In a detection stage, the control sub-circuit 1030 is configured to generate and output the first sub-voltage signal to the second electrode of the light-emitting element 1012, thereby controlling the light-emitting element 1012 to be turned off, that is, the detection circuit 103 is configured to detect the electrical parameter at the first electrode of the light-emitting element 1012 in a case where the second electrode of the light-emitting element 1012 receives the first sub-voltage signal of the variable voltage Vc. In a display stage, the control sub-circuit 1030 is configured to generate and output a second sub-voltage signal to the second electrode of the light-emitting element 1012, thereby controlling the light-emitting element 1012 to be turned on. A drive current transmitted via the drive transistor can flow through the light-emitting element 1012 to control the light-emitting element 1012 to emit light, that is, the drive transistor can drive the light-emitting element 1012 to emit light in a case where the second electrode of the light-emitting element 1012 receives the second sub-voltage signal of the variable voltage Vc.

For example, the light-emitting element 1012 may be a light-emitting diode or the like. The light-emitting diode may be an organic light-emitting diode (OLED) or a quantum dot light-emitting diode (QLED) or the like. The light-emitting element 1012 is configured to receive a light-emitting signal (which may be, for example, a drive current signal) when be in operation and emit light with an intensity corresponding to the light-emitting signal.

For example, the first electrode of the light-emitting element 1012 may be an anode, and the second electrode of the light-emitting element 1012 may be a cathode. Alternatively, in some embodiments, the first electrode of the light-emitting element 1012 may be a cathode and the second electrode of the light-emitting element 1012 may be an anode, and the pixel circuit, the variable voltage, and the like may be adjusted accordingly according to the configuration.

For example, the display panel 100 may be an organic light-emitting diode (OLED) display panel, and the organic light-emitting diode (OLED) display panel may be an active matrix driven OLED display panel, for example.

For example, as shown in FIG. 1A, FIG. 1B, FIG. 2A, and FIG. 2B, the display panel 100 further includes an array substrate 110 and a drive chip 111. The drive chip 111 is bonded to the array substrate 110 through a flexible circuit board, and the array substrate 110 includes a sub-pixel 101, i.e., the sub-pixel 101 are formed on the array substrate 110. The drive chip 111 includes the detection circuit 103, that is, the detection circuit 103 may be integrated on the drive chip 111. Therefore, the display panel 100 can complete brightness compensation by relying on the display panel 100 itself instead of relying on external detection tools. For another example, the detection circuit 103 may be implemented as a separate detection chip in addition to being a part of the drive chip 111, and be electrically connected to a signal detection line, a common voltage line, and the like by a bonding mode or the like.

It should be noted that FIG. 1A and FIG. 1B only show one sub-pixel 101, but the embodiments of the present disclosure is not limited thereto. The display panel 100 may include a plurality of sub-pixels 101, and the plurality of sub-pixels 101 are arranged in an array on the array substrate 110 of the display panel 100.

For example, in the detection circuit 103, the control sub-circuit 1030 may be implemented by a hardware circuit. For another example, the control sub-circuit 1030 may also be implemented by a signal processor such as a field-programmable gate array (FPGA), a digital signal processing (DSP), etc. The control sub-circuit 1030 may include, for example, a processor and a memory, the processor executes a software program stored in the memory to control the control sub-circuit 1030 to achieve a function of generating and outputting the variable voltage Vc.

For example, as shown in FIG. 2A, the detection circuit 103 may further include a first sub-circuit 1031 and a second sub-circuit 1032. The detection signal terminal DT of the detection circuit 103 includes a first terminal of the first sub-circuit 1031, and the first terminal of the first sub-circuit 1031, which serves as the detection signal terminal DT, is connected to the first electrode of the light-emitting element 1012, a second terminal of the first sub-circuit 1031 is connected to the second sub-circuit 1032, a control terminal of the first sub-circuit 1031 is configured to receive a switch control signal $V_{SC}$, and the first sub-circuit 1031 is configured to disconnect or connect the second sub-circuit 1032 and the first electrode of the light-emitting element 1012 under control of the switch control signal $V_{SC}$. The second sub-circuit 1012 is configured to detect the electrical parameter at the first electrode of the light-emitting element 1012.

For example, the first sub-circuit 1031 includes a switch element, the first terminal of the first sub-circuit 1031 serves as an input terminal of the switch element, the second terminal of the first sub-circuit 1031 serves as an output terminal of the switch element, and the control terminal of the first sub-circuit 1031 serves as a control terminal of the switch element.

Figure 3:
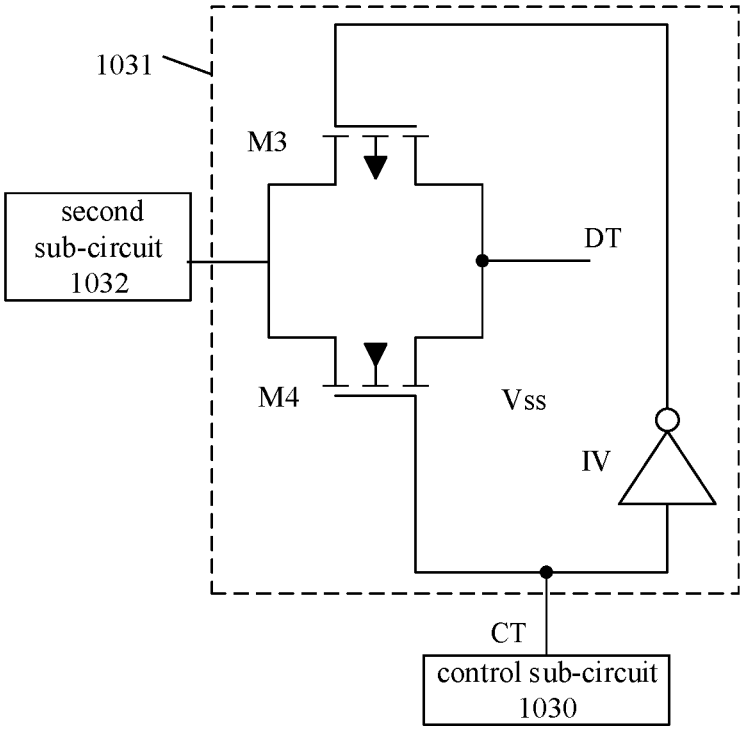
FIG. 3 is a schematic structural diagram of a detection circuit provided by at least one embodiment of the present disclosure.

FIG. 3 is a schematic structural diagram of a detection circuit provided by at least one embodiment of the present disclosure.

For example, in some examples, the switch element may include a CMOS transmission gate or other circuit that can transmit analog signals. For example, as shown in FIG. 3, the CMOS transmission gate may include a P-type transistor M3 (e.g., a P-channel enhanced metal-oxide-semiconductor field-effect transistor (MOSFET)), an N-type transistor M4 (e.g., an N-channel enhanced MOSFE) and an inverter IV, and the P-type transistor M3 and the N-type transistor M4 are arranged in parallel. The input terminal of the switch element includes a first electrode of the P-type transistor M3 and a first electrode of the N-type transistor M4, that is, the detection signal terminal DT of the detection circuit 103 includes the first electrode of the P-type transistor M3 and the first electrode of the N-type transistor M4; the output terminal of the switch element includes a second electrode of the P-type transistor M3 and a second electrode of the N-type transistor M4; and the control terminal of the switch element includes an input terminal of the inverter IV and a gate electrode of the N-type transistor M4. The first electrode of the P-type transistor M3 and the first electrode of the N-type transistor M4 are electrically connected and both connected to the first electrode of the light-emitting element 1012; the second electrode of the P-type transistor M3 and the second electrode of the N-type transistor M4 are also electrically connected and both are electrically connected to the second sub-circuit 1032; and the gate electrode of the N-type transistor M4 is configured to receive the switch control signal $V_{SC}$, a gate electrode of the P-type transistor M3 is electrically connected to an output terminal of the inverter IV, and the input terminal of the inverter IV is configured to receive the switch control signal $V_{SC}$.

For another example, in other examples, the switch element may include a thin film transistor, the input terminal of the switch element is a first electrode of the thin film transistor, the output terminal of the switch element is a second electrode of the thin film transistor, and the control terminal of the switch element is a gate electrode of the thin film transistor.

It should be noted that the embodiments of the present disclosure do not limit the specific structure of the first sub-circuit 1031 as long as the first sub-circuit 1031 can achieve the function of disconnecting or conducting the second sub-circuit 1032 and the first electrode of the light-emitting element 1012 under control of the switch control signal $V_{SC}$.

For example, as shown in FIG. 2B, the control voltage terminal CT is also connected to the control terminal of the first sub-circuit 1031 to transmit the variable voltage Vc to the control terminal of the first sub-circuit 1031, and the variable voltage Vc serves as the switch control signal $V_{SC}$. At this time, the first sub-circuit 1031 is turned on under control of the first sub-voltage signal, and the first sub-circuit 1031 is turned off under control of the second sub-voltage signal.

It should be noted that the control sub-circuit 1030 is further configured to generate the switch control signal $V_{SC}$ and output the switch control signal $V_{SC}$ to the control terminal of the first sub-circuit 1031. In this case, the switch control signal $V_{SC}$ may also be a variable signal and includes a first sub-switch signal and a second sub-switch signal. In the detection stage, the control sub-circuit 1030 is configured to generate and output the first sub-switch signal to the control terminal of the first sub-circuit 1031, thereby controlling the first sub-circuit 1031 to be turned on; and in the display stage, the control sub-circuit 1030 is configured to generate and output the second sub-switch signal to the control terminal of the first sub-circuit 1031, thereby controlling the first sub-circuit 1031 to be turned off. For example, in some examples, the first sub-switch signal is a high level signal and the second sub-switch signal is a low level signal, but the embodiments of the present disclosure is not limited thereto, and specific values and types of the first sub-switch signal and the second sub-switch signal may be set according to the specific circuit structure of the first sub-circuit 1031.

For example, the second sub-circuit 1032 may be implemented by a hardware circuit. The second sub-circuit 1032 may include, for example, transistors, resistors, capacitors, amplifiers, and the like. For another example, the second sub-circuit 1032 may further include a processor and a memory, the memory may store a computer program suitable for execution by the processor, and the computer program may be executed by the processor to perform operations, such as control, calculation, and the like, to achieve the function of detecting electrical parameters of the light-emitting element 1012. Those skilled in the art should understand that in practice, a microprocessor or DPS may also be used to implement some or all of the functions of the second sub-circuit 1032 provided by the embodiments of the present disclosure.

For example, as shown in FIG. 1B, in some embodiments, the display panel 100 may further include a compensation circuit 104. The detection circuit 103 is configured to detect a plurality of electrical parameters at the first electrode of the light-emitting element 1012. The compensation circuit 104 is configured to calculate to obtain a compensated data voltage based on an initial data voltage according to the plurality of electrical parameters. The compensated data voltage serves as a display data voltage and is applied to the sub-pixel 101 to perform a display operation, that is, the display data voltage may include the compensated data voltage.

It should be noted that the "initial data voltage" herein represents a data voltage corresponding to a brightness that an application such as a video expects the sub-pixel 101 of the display panel 100 to present, before a data compensation process provided by the embodiments of the present disclosure is performed. For example, in a case where a picture is displayed, the compensated data voltage, which serves as the display data voltage, is applied to a pixel circuit of the sub-pixel to drive a light-emitting element to emit light.

For example, the compensation circuit 104 may be connected to a data driver (e.g., a data driver circuit or a data driver chip), and the compensated data voltage may be transmitted to the data driver and transmitted to the pixel circuit 1011 of the sub-pixel 101 via the data driver.

For example, as shown in FIG. 2A and FIG. 2B, in some examples, the compensation circuit 104 includes a calculation module 1041 and a first storage sub-circuit 1042. The calculation module 1041 is configured to acquire a plurality of detection data voltages, which are in one-to-one correspondence to the plurality of electrical parameters, for the sub-pixel 101, calculate to obtain a characteristic parameter of the pixel circuit 1011 according to the plurality of electrical parameters and the plurality of detection data voltages, and calculate to obtain the compensated data voltage based on the initial data voltage according to the characteristic parameter. The first storage sub-circuit 1042 is configured to store the characteristic parameter.

For example, a reference light-emitting current corresponding to the initial data voltage can be obtained based on the initial data voltage, and according to the reference light-emitting current and the characteristic parameter, the compensated data voltage can be calculated through a saturation current formula of the drive transistor in the pixel circuit.

For example, in other examples, the compensation circuit 104 includes a calculation module 1041 and a first storage sub-circuit 1042. The calculation module 1041 is configured to: acquire a plurality of detection data voltages for the sub-pixels 101, the plurality of detection data voltages being in one-to-one correspondence to the plurality of electrical parameters; calculate a characteristic parameter of the pixel circuit 1011 according to the plurality of electrical parameters and the plurality of detection data voltages; calculate to obtain a plurality of standard compensation data voltages, which are in one-to-one correspondence to all gray scale levels of the sub-pixel 101, according to the characteristic parameter; acquire the compensated data voltage corresponding to the initial data voltage based on the plurality of standard compensation data voltages. The first storage sub-circuit 1042 is configured to store the plurality of standard compensation data voltages.

For example, a lookup table of a plurality of gray scale levels and the plurality of standard compensation data voltages can be established. In the display stage, according to a gray scale level corresponding to a brightness required to be displayed by a certain sub-pixel, a standard compensation data voltage corresponding to the gray scale level can be queried in the lookup table and serves as a compensated data voltage. It should be noted that in a case where the characteristic parameters of the pixel circuit 1011 change during the use of the display panel, the lookup table needs to be updated accordingly.

For example, in a case where an operation of calculating the plurality of standard compensation data voltages, which are in one-to-one correspondence to all gray scale levels of the sub-pixels 101, according to the characteristic parameter is performed, the calculation module 1041 is configured to: select a plurality of reference gray scale levels; calculate a plurality of reference light-emitting currents, which are in one-to-one correspondence to the plurality of reference gray scale levels, based on a corresponding relation between a current of the light-emitting element and a brightness of the light-emitting element; calculate a plurality of reference compensation data voltages, which are in one-to-one correspondence to the plurality of reference gray scale levels, according to the characteristic parameter and the plurality of reference light-emitting currents; performing voltage dividing operation on the plurality of reference compensation data voltages to generate the plurality of standard compensation data voltages, which are in one-to-one correspondence to the plurality of gray scale levels (i.e., all gray scale levels) of the display panel. For example, the plurality of standard compensation data voltages may include the plurality of reference compensation data voltages.

For example, the plurality of standard compensation data voltages can be obtained from the plurality of reference compensation data voltages by an interpolation algorithm method. According to the plurality of standard compensation data voltages, a gamma curve of the sub-pixels of the display panel can be adjusted.

For example, the plurality of gray scale levels of the display panel 100 may include 256 gray scale levels (0-255 gray scales), i.e., each sub-pixel may be represented by 8-bit data. The plurality of reference gray scale levels may be selected from the plurality of gray scale levels (e.g., 256 gray scale levels) of the display panel 100. The number of the plurality of reference gray scale levels may range from 20 to 30. For example, for low gray scales, an interval between two adjacent reference gray scale levels is small, for high gray scales, an interval between two adjacent reference gray scale levels is large, and the number of the plurality of reference gray scale levels can be specifically selected according to actual conditions. The embodiments of the present disclosure does not limit the number and specific values of the plurality of reference gray scale levels.

It should be noted that in the embodiments of the present disclosure, the gray scale levels gradually increases from 0 gray scale to 255 gray scale.

For example, the data driver may generate and output a plurality of detection data voltages to the calculation module 1041.

For example, the plurality of detection data voltages may be preset by a system and generated by the data driver, or the plurality of detection data voltages may be randomly generated by the data driver.

For example, the first storage sub-circuit 1042 may include various forms of computer readable storage media, such as volatile memory and/or nonvolatile memory. The volatile memory may include, for example, random access memory (RAM) and/or cache, etc. The nonvolatile memory may include, for example, read only memory (ROM), hard disk, erasable programmable read only memory (EPROM), portable compact disk read only memory (CD-ROM), USB memory, flash memory, and the like.

For example, the calculation module 1041 may be implemented by a signal processor such as FPGA, DSP, etc. For example, the calculation module 1041 may include a processor, and the first storage sub-circuit 1042 may also store a computer program suitable for execution by the processor, and the computer program may be executed by the processor to implement some or all of the functions of the calculation module 1041.

For example, the pixel circuit 1011 may be a basic 2T1C type pixel circuit, so that the display panel 100 can have a high an aperture ratio and the manufacturing process of the display panel 100 can be simplified. As shown in FIG. 2A and FIG. 2B, the pixel circuit 1011 may include a drive sub-circuit 1013, a data writing sub-circuit 1014, and a second storage sub-circuit 1015. The data writing sub-circuit 1014 is configured to write a received display data voltage into the second storage sub-circuit 1015 under control of a scan signal; the second storage sub-circuit 1015 is configured to store the display data voltage and maintain the display data voltage at a control terminal of the drive sub-circuit 1013; and the drive sub-circuit 1013 is configured to drive the light-emitting element 1012 to emit light under control of the display data voltage in a case where the second electrode of the light-emitting element 1012 receives the second sub-voltage signal.

For example, as shown in FIG. 2A and FIG. 2B, in some embodiments, the drive sub-circuit 1013 may include a drive transistor M1, the data writing sub-circuit 1014 may include a data writing transistor M2, and the second storage sub-circuit 1015 may include a storage capacitor Cst. A first electrode of the drive transistor M1 is electrically connected to a power supply Vdd, a second electrode of the drive transistor M1 is electrically connected to the first electrode of the light-emitting element 1012, a gate electrode of the drive transistor M1 is electrically connected to a second electrode of the data writing transistor M2, and the gate electrode of the drive transistor M1 is also electrically connected to a first terminal of the storage capacitor Cst. A first electrode of the data writing transistor M2 is electrically connected to a data line D to receive the display data voltage, and a gate electrode of the data writing transistor M2 is electrically connected to a gate line S to receive the scan signal. A second terminal of the storage capacitor Cst is electrically connected to the power supply Vdd.

For example, the characteristic parameter of the pixel circuit 1011 may include a threshold voltage Vth and a process constant β of the drive transistor M1. For example, the process constant β represents a characteristic of the drive transistor M1 itself. Due to limitations of the manufacturing process, process constants 13 of respective drive transistors are different. The process constant β of the drive transistor M1 can be expressed as:

$$\beta=\mu_n C_{ox}(W/L)$$

where $\mu_n$ is an electron mobility of the drive transistor M1, $C_{ox}$ is an unit capacitance of the gate electrode of the drive transistor M1, W is a channel width of the drive transistor M1, and L is a channel length of the drive transistor M1.

Similarly, threshold voltages Vth of drive transistors M1 of the respective sub-pixels may be different. Moreover, with the increase of usage time, both the threshold voltage Vth and the process constant β of the drive transistor M1 have drift problems, and threshold voltages Vth and process constants 13 of drive transistors M1 of different sub-pixels have different drift amounts.

For example, the power supply Vdd may be a DC power supply. The power supply Vdd may be, for example, a high voltage source to output a constant positive power supply voltage.

For example, the first sub-voltage signal may be identical to a power supply voltage output by the power supply Vdd.

It should be noted that the embodiments of the present disclosure are described by taking a case that the pixel circuit 1011 adopts the 2T1C structure as an example, but the pixel circuit 1011 in the embodiment of the present disclosure is not limited to the 2T1C structure. For example, the pixel circuit 1011 may further include a transmission transistor, a light-emitting control transistor, a reset transistor, an internal compensation transistor, and the like, as required. The embodiments of the present disclosure does not limit the specific structure of the pixel circuit.

For example, transistors (e.g., P-type transistors and N-type transistors) in the above-mentioned switch element, the drive transistor M1 and the data writing transistor M2 can be prepared by a low-temperature polysilicon process, so that a mobility of the transistor is relatively high, thus the transistors can be prepared smaller and an aperture ratio of the display panel can be increased.

It should be noted that during the use of the display panel, the detection circuit 103 can also detect the electrical parameters of the light-emitting element 1012, determine the characteristic parameter of the drive transistor in the pixel circuit according to the electrical parameters of the light-emitting element 1012, and then compensate the data voltage at each gray scale according to the characteristic parameter of the drive transistor, thereby avoiding the influence of the aging of the drive transistor on the brightness of the display panel.

For example, as shown in FIG. 2A and FIG. 2B, the first electrode of the light-emitting element 1012 is connected to the detection signal terminal DT of the detection circuit 103 through a signal detection line 1016, and a first trace resistance Rtg, that is, a line resistance on the signal detection line 1016, exists between the first electrode of the light-emitting element 1012 and the detection signal terminal DT of the detection circuit 103. The power supply Vdd is also connected to the pixel circuit 1011 of the sub-pixel 101 through a signal line, so a second trace resistance Rds exists between the power supply Vdd and the pixel circuit 1011 of the sub-pixel 101. In the display panel 100, first trace resistances Rtg corresponding to the respective sub-pixels 101 are different and second trace resistances Rds corresponding to the respective sub-pixels 101 are also different, but the first trace resistances Rtg and the second trace resistances Rds corresponding to the respective sub-pixels 101 are all fixed values and can be measured in advance.

For example, before the display panel 100 is shipped from a factory, a brightness detection operation may be performed on the display panel 100 to obtain the characteristic parameter of the pixel circuit 1011. It should be noted that the brightness detection operation can be implemented by the display panel 100.

At least one embodiment of the present disclosure also provides a display panel. For example, as shown in FIG. 2B, the display panel 100 includes a sub-pixel and a detection circuit 103. The sub-pixel includes a pixel circuit 1011 and a light-emitting element 1012. The pixel circuit 1011 includes a drive transistor M1, a data writing transistor M2, and a storage capacitor Cst. The detection circuit 103 includes a first sub-circuit 1031 and a second sub-circuit 1032, and the first sub-circuit 1031 includes a switch element.

For example, a first electrode of the drive transistor M1 is electrically connected to a power supply Vdd, a second electrode of the drive transistor M1 is electrically connected to a first electrode of the light-emitting element 1012, a gate electrode of the drive transistor M1 is electrically connected to a second electrode of the data writing transistor M2, the gate electrode of the drive transistor M1 is also electrically connected to a first terminal of the storage capacitor Cst, a first electrode of the data writing transistor M2 is configured to receive a display data voltage, and a gate electrode of the data writing transistor M2 is configured to receive a scan signal. For example, the first electrode of the data writing transistor M2 is electrically connected to a data line D to receive the display data voltage, and the gate electrode of the data writing transistor M2 is electrically connected to a gate line S to receive the scan signal. A second terminal of the storage capacitor Cst is electrically connected to the power supply Vdd. A second electrode of the light-emitting element 1012 is configured to receive a variable voltage Vc, and the variable voltage Vc includes a first sub-voltage signal. An input terminal of the switch element is connected to the first electrode of the light-emitting element 1012, an output terminal of the switch element is connected to the second sub-circuit 1032, a control terminal of the switch element is configured to receive the variable voltage Vc, and the switch element is turned on in a case where the control terminal of the switch element receives the first sub-voltage signal. The second sub-circuit 1032 is configured to detect an electrical parameter at the first electrode of the light-emitting element 1012 in a case where the second electrode of the light-emitting element 1012 receives the first sub-voltage signal.

For example, the variable voltage Vc further includes a second sub-voltage signal, a level of the first sub-voltage signal is different from a level of the second sub-voltage signal, for example, the first sub-voltage signal is a high-level signal and the second sub-voltage signal is a low-level signal. In a case where the second electrode of the light-emitting element 1012 receives the second sub-voltage signal, the drive transistor M1 may drive the light-emitting element 1012 to emit light.

For example, as shown in FIG. 2B, in some embodiments, the display panel 100 may further include a compensation circuit 104. The compensation circuit 104 is configured to calculate to obtain a compensated data voltage based on an initial data voltage according to a plurality of electrical parameters, which are detected by the detection circuit 103, at the first electrode of the light-emitting element 1012.

It should be noted that the relevant descriptions of the sub-pixels, the detection circuit 103, the compensation circuit 104, and the like in the display panel provided in the embodiments can refer to the above-mentioned relevant descriptions of the display panel as shown in FIG. 2A and FIG. 2B, and the repetitions are not repeated here again.

Figure 4:
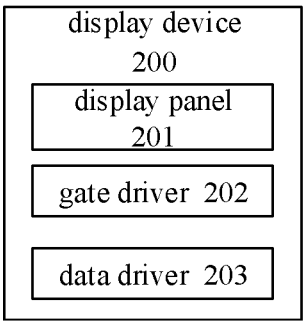
FIG. 4 is a schematic block diagram of a display device provided by at least one embodiment of the present disclosure.

At least one embodiment of the present disclosure also provides a display device. FIG. 4 is a schematic block diagram of a display device provided by at least one embodiment of the present disclosure. For example, as shown in FIG. 4, the display device 200 may include a display panel 201, and the display panel 201 is used for displaying images. The display panel 201 may be the display panel 100 provided by any one of the above embodiments.

For example, the display panel 201 may be a rectangular panel, a circular panel, an elliptical panel, a polygonal panel, or the like. In addition, the display panel 201 may be not only a flat panel, but also a curved panel or even a spherical panel. For another example, the display panel 201 may also have a touch function, that is, the display panel 201 may be a touch display panel.

For example, as shown in FIG. 4, the display device 200 may further include a gate driver 202. As shown in FIG. 2A and FIG. 2B, the gate driver 202 is configured to be electrically connected to data writing circuits 1014 of sub-pixels in a row, for example, through a gate line S, for providing a scan signal to the data writing circuits 1014 of the sub-pixels in the row to control to turn on or turn off the data writing circuits 1014 in a display period of one frame.

For example, as shown in FIG. 4, the display device 200 may further include a data driver 203. As shown in FIG. 2A and FIG. 2B, the data driver 203 is configured to be electrically connected to data writing circuits 1014 of sub-pixels in a column, for example, through a data line D, for supplying the display data voltage to the data writing circuits 1014 of the sub-pixels in the column.

For example, the gate driver 202 and the data driver 203 may be integrated on a drive chip of the display panel 200. For another example, the gate driver 202 and the data driver 203 may be implemented by respective application specific integrated circuit chips, respectively. For still another example, the gate driver 202 and the data driver 203 may also be integrated on the array substrate of the display panel 200. The embodiments of the present disclosure are not limited thereto.

For example, the display device 200 may be any product or component having a display function such as a mobile phone, a tablet computer, a television, a display, a notebook computer, a digital photo frame, a navigator, etc.

It should be noted that other components (e.g., a control device, an image data encoding/decoding device, a clock circuit, etc.) of the display device 200 are those which those of ordinary skill in the art should understand, are not described in detail herein again, and should not be construed as limiting the embodiments of the present disclosure.

Figure 5A:
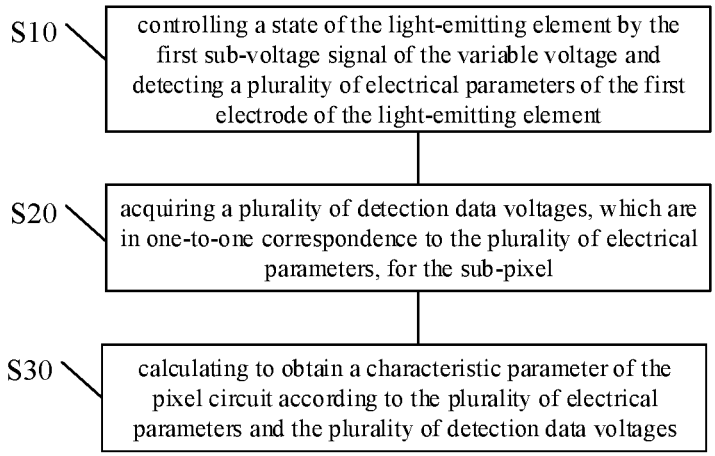
FIG. 5A is a flowchart of a detection method provided by at least one embodiment of the disclosure.
Figure 5B:
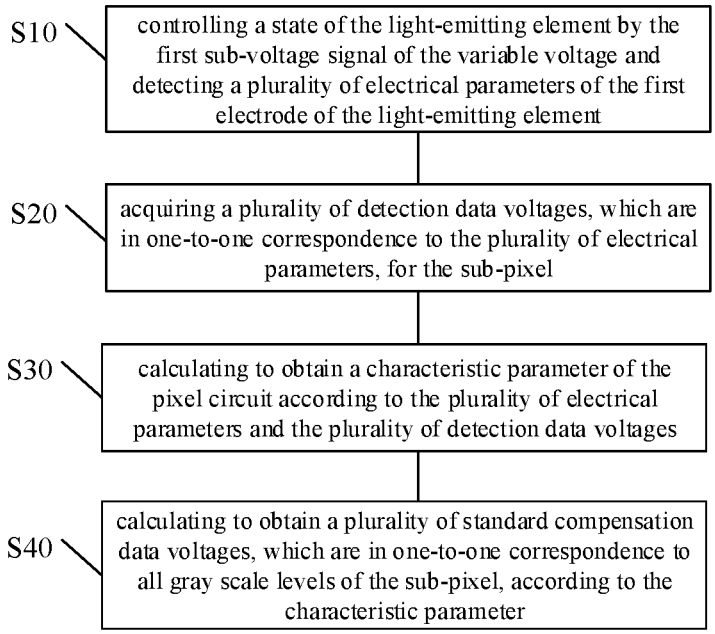
FIG. 5B is a flowchart of another detection method provided by at least one embodiment of the disclosure.

The embodiments of the present disclosure also provides a detection method, and the detection method can be applied to the display panel 100 provided by any one of the above embodiments. FIG. 5A is a flowchart of a detection method provided by at least one embodiment of the disclosure; FIG. 5B is a flowchart of another detection method provided by at least one embodiment of the disclosure.

For example, as shown in FIG. 5A and FIG. 5B, the detection method provided by the embodiments of the present disclosure may include the following steps.

S10: controlling a state of the light-emitting element by the first sub-voltage signal of the variable voltage and detecting a plurality of electrical parameters of the first electrode of the light-emitting element.

For example, step S10 may include controlling the light-emitting element to be in a turn-off state through the first sub-voltage signal to detect the plurality of electrical parameters acquired by the first electrode of the light-emitting element.

It should be noted that step S10 can be implemented by the detection circuit 103 in the above-mentioned display panel 100, and a specific operation process of step S10 can refer to the above-mentioned description about the detection circuit 103, and details will not be repeated herein again.

For example, as shown in FIG. 5A, the detection method further includes:

S20: acquiring a plurality of detection data voltages, which are in one-to-one correspondence to the plurality of electrical parameters, for the sub-pixel.

S30: calculating to obtain a characteristic parameter of the pixel circuit according to the plurality of electrical parameters and the plurality of detection data voltages.

For example, the pixel circuit of the display panel includes a drive sub-circuit, and the drive sub-circuit includes a drive transistor. The characteristic parameter of the pixel circuit include a threshold voltage Vth and a process constant β of the drive transistor.

For example, the above steps S10, S20, and S30 are all performed in the detection stage.

For example, as shown in FIG. 5B, in some embodiments, the detection method further includes:

S40: calculating to obtain a plurality of standard compensation data voltages, which are in one-to-one correspondence to all gray scale levels of the sub-pixel, according to the characteristic parameter.

For example, in some embodiments, step S40 may include:

S401: selecting a plurality of reference gray scale levels;

S402: calculating a plurality of reference light-emitting currents, which are in one-to-one correspondence to the plurality of reference gray scale levels, based on a corresponding relation between a current of the light-emitting element and a brightness of the light-emitting element;

S403: calculating a plurality of reference compensation data voltages, which are in one-to-one correspondence to the plurality of reference gray scale levels, according to the characteristic parameter and the plurality of reference light-emitting currents; and S404: calculating a plurality of standard compensation data voltages, which are in one-to-one correspondence to the all gray scale levels, according to the plurality of reference compensation data voltages.

For example, the plurality of reference gray scale levels may be a portion of gray scale levels selected from all gray scale levels of the sub-pixel. The number of all gray scale levels of the sub-pixel may be 256 (i.e., 0-255 gray scales), and the number of the plurality of reference gray scale levels may be 20, 25, 30, and so on.

For example, the plurality of reference gray scale levels are in one-to-one correspondence to the plurality of detection data voltages.

It should be noted that steps S20, S30 and S40 can be performed by the compensation circuit 104 in the above-mentioned display panel 100, and specific operation processes of steps S20, S30 and S40 can refer to the related description of the above-mentioned compensation circuit 104 and will not be repeated here again.

For example, the above-mentioned step S40 is also performed in the detection stage.

For example, in some embodiments, the display panel includes M rows and N columns of sub-pixels, i.e., a resolution of the display panel is M*N, and M and N are positive integers. Taking the display panel as shown in FIG. 2B as an example, in the detection stage, first, the detection circuit 103 of the display panel 100 can generate and output the first sub-voltage signal to the second electrode of the light-emitting element 1012 to control the light-emitting element 1012 to be in a turn-off state, such as a reverse turn-off state. The first sub-voltage signal may be identical to the power supply voltage output by the power supply Vdd, for example. At this time, no current flows through the light-emitting element 1012, so the light-emitting element 1012 does not emit light. The first sub-voltage signal can simultaneously control the first sub-circuit 1031 of the detection circuit 103 to be turned on. Then, the gate line S transmits a scan signal to the data writing transistor M2 to control the data writing transistor M2 to be turned on, and an n-th detection data voltage Vdn of the plurality of detection data voltages on the data line D can be transmitted to the first terminal of the storage capacitor Cst to charge the storage capacitor Cst. At the end of charging, a gate voltage Vg of the drive transistor M1 is Vdn. Because a source voltage Vs of the drive transistor M1 is V1−Vrds, a gate-source voltage Vgs of the drive transistor M1 becomes Vdn−(V1−Vrds), where V1 is the power supply voltage output by the power supply Vdd, and Vrds is a voltage drop of the second trace resistance Rds and is fixed. At this time, the drive transistor M1 is in a saturated state, and a drive current In flowing through the drive transistor M1 is expressed as:

$$In=\tfrac{1}{2}\cdot\beta\cdot(Vdn-V1+Vrds-Vth)^2 \quad (1)$$

where the process constant β of the drive transistor M1 can be expressed as:

$$\beta=\mu\cdot\frac{W}{L}\cdot C_{ox}$$

Thus, the drive current In flowing through the drive transistor M1 can be expressed as:

$$\mathrm{In}=\frac{1}{2}\cdot\mu\cdot\frac{W}{L}\cdot C_{ox}\cdot(Vdn-V1+Vrds-Vth)^2$$

For example, the drive current In may be detected by the detection circuit 103 through the signal detection line 1016, and the electrical parameter at the first electrode of the light-emitting element may include the drive current In. For a display panel with a resolution of M*N, drive currents of all sub-pixels on the display panel can be detected, and the drive currents of all sub-pixels can form a current matrix $L_{MN}$. A drive current corresponding to a sub-pixel located in a M-th row and N-th column is represented as $I_{MN}$, and thus, the current matrix $L_{MN}$ can be represented as follows:

$$L_{MN}=\begin{bmatrix} I_{11} & \cdots & I_{1N} \\ \vdots & \ddots & \vdots \\ I_{M1} & \cdots & I_{MN} \end{bmatrix}$$

For example, according to current characteristics of the light-emitting elements, a target current matrix $L_{MN0}$ in a case where a brightness of the display panel is uniform can be obtained. For example, the target current matrix $L_{MN0}$ can be expressed as:

$$L_{MN0}=\begin{bmatrix} I'_{11} & \cdots & I'_{1N} \\ \vdots & \ddots & \vdots \\ I'_{M1} & \cdots & I'_{MN} \end{bmatrix}$$

For example, the target current matrix $L_{MN0}$ can be obtained by an experiment method, and the target current matrix $L_{MN0}$ can be used as a basis for brightness compensation.

For example, in some examples, the process unevenness of the light-emitting element may be not considered, a corresponding formula of a current and a brightness of the light-emitting elements can be directly used, and the target current matrix $L_{MN0}$ can be calculated to obtain based on a set display brightness by the corresponding formula of the current and the brightness of the light-emitting elements, for example, in a case where the set display brightness of all light-emitting elements on the display panel is the same, all currents in the target current matrix $L_{MN0}$ are also the same, it should be noted that, in the example, based on the target current matrix $L_{MN0}$, the brightness emitted by at least some light-emitting elements on the display panel may be different and different from the set display brightness.

For another example, in other examples, due to process limitations, the characteristics of respective light-emitting elements on the display panel are different, therefore, under the same current, the brightness of the respective light-emitting elements are still different, the target current matrix $L_{MN0}$ may be a current matrix obtained after brightness differences caused by the different characteristics of the respective light-emitting elements are compensated, so that in the target current matrix $L_{MN0}$, respective currents may be different or may be at least partially different.

In embodiments of the present disclosure, respective currents, flowing through the light-emitting element, in the current matrix $L_{MN}$ and respective currents in the target current matrix $L_{MN0}$ can be in one-to-one correspondence respectively and be the same, so that the display uniformity of the display panel can be prevented from being affected by the non-uniform of the characteristics of the drive transistors, and the uniformity of the display panel can be improved.

For example, according to the above-mentioned calculation formula (1) of the drive current In, the calculation formula of the n-th detection data voltage Vdn can be obtained:

$$Vdn = \sqrt{\frac{2 \cdot \mathrm{In}}{\beta}} + V1 - Vrds + Vth \tag{2}$$

For each sub-pixel, both the power supply voltage V1 and the voltage drop Vrds across the second trace resistance Rds are known values and fixed.

In a case where the detection method is the detection method in the embodiment as shown in FIG. 5A, according to the above formula (2), the threshold voltage Vth and the process constant β of the drive transistor of the sub-pixel can be obtained by two detection data voltages and two drive currents (i.e., two electrical parameters detected by the detection circuit) corresponding to the two detection data voltages. In a case where the detection method is the detection method in the embodiment as shown in FIG. 5B, after obtaining the threshold voltage Vth and the process constant β of the drive transistor, based on the selected plurality of reference gray scale levels, the plurality of reference light-emitting currents, which are in one-to-one correspondence to the plurality of reference gray-scale levels, are obtained from a plurality of target current matrices $L_{MN0}$ (for example, the plurality of target current matrices $L_{MN0}$ are in one-to-one correspondence to the plurality of reference gray scale levels, that is, a target current matrix $L_{MN0}$ can be obtained according to a reference gray scale level), and then, according to the plurality of reference light-emitting currents, the plurality of reference compensation data voltages, which are one-to-one correspondence to the plurality of reference gray scale levels, can be calculated by using the above formula (2). Finally, according to the plurality of reference compensation data voltages, the plurality of standard compensation data voltages, which are in one-to-one correspondence to the all gray scale levels, can be calculated by, for example, an interpolation algorithm.

For example, in some embodiments, the light-emitting element of a sub-pixel of the display panel is configured to display the brightness corresponding to an S-th gray scale level. S is a positive integer, and S is greater than or equal to 0 and less than a total number of the plurality of gray scale levels of the display panel. In a case where the plurality of gray scale levels of the display panel can include 256 gray scale levels, 0<S<255. Thus, for the sub-pixel, in the display stage, in some examples, in a case where the detection method is the detection method in the embodiment as shown in FIG. 5A, the display panel is configured to: based on an S-th initial data voltage corresponding to the S-th gray scale level, acquire an S-th reference light-emitting current corresponding to the S-th gray scale level from the target current matrix $L_{MN0}$; calculate the compensated data voltage according to the characteristic parameter of the pixel circuit and the S-th reference light-emitting current; and drive the light-emitting element in the sub-pixel to emit light base on the compensated data voltage. The light-emitting brightness of the light-emitting element is the brightness corresponding to the S-th gray scale level.

In other examples, in a case where the detection method is the detection method in the embodiment as shown in FIG. 5B, the display panel is configured to: select, from the plurality of standard compensation data voltages, a standard compensation data voltage corresponding to the S-th gray scale level as the compensated data voltage; and drive the light-emitting element in the sub-pixel to emit light based on the compensated data voltage.

For the present disclose, the following statements should be noted:

1) Only the structures involved in the embodiments of the present disclosure are illustrated in the drawings of the embodiments of the present disclosure, and other structures can refer to usual designs.

(2) In case of no conflict, the embodiments of the present disclosure and features in the embodiments of the present disclosure may be combined to obtain new embodiments.

What have been described above are only specific implementations of the present disclosure, but the protection scope of the present disclosure is not limited thereto, and the protection scope of the present disclosure should be based on the protection scope of the claims.

What is claimed is:

1. A display panel, comprising a sub-pixel and a detection circuit, and a compensation circuit, wherein the sub-pixel comprises a pixel circuit and a light-emitting element, and the pixel circuit is connected to the light-emitting element and is configured to drive the light-emitting element to emit light;

the detection circuit comprises a detection signal terminal and a control voltage terminal, a first electrode of the light-emitting element is connected to the detection signal terminal, and a second electrode of the light-emitting element is connected to the control voltage terminal; and the detection circuit is configured to output a variable voltage, through the control voltage terminal, to the second electrode of the light-emitting element, the variable voltage comprises a first sub-voltage signal, and the detection circuit is further configured to detect an electrical parameter at the first electrode of the light-emitting element in a case where the first sub-voltage signal is applied to the second electrode of the light-emitting element;

the detection circuit is further configured to detect a plurality of electrical parameters at the first electrode of the light-emitting element; and the compensation circuit is configured to calculate to obtain a compensated data voltage based on an initial data voltage according to the plurality of electrical parameters, and the compensated data voltage serves as a display data voltage for the sub-pixel to perform a display operation.

2. The display panel according to claim 1, wherein the variable voltage further comprises a second sub-voltage signal, a level of the first sub-voltage signal is different from a level of the second sub-voltage signal, and the detection circuit is further configured to apply the second sub-voltage signal to the second electrode of the light-emitting element such that the light-emitting element is capable of being driven to emit light.

3. The display panel according to claim 2, wherein the pixel circuit comprises a drive sub-circuit, a data writing sub-circuit, and a second storage sub-circuit, the data writing sub-circuit is configured to write a display data voltage that is received into the second storage sub-circuit under control of a scan signal;

the second storage sub-circuit is configured to store the display data voltage and maintain the display data voltage at a control terminal of the drive sub-circuit; and the drive sub-circuit is configured to drive the light-emitting element to emit light under control of the display data voltage in a case where the second sub-voltage signal is applied to the second electrode of the light-emitting element.

4. The display panel according to claim 3, wherein the drive sub-circuit comprises a drive transistor, the data writing sub-circuit comprises a data writing transistor, the second storage sub-circuit comprises a storage capacitor, a first electrode of the drive transistor is electrically connected to a power supply, a second electrode of the drive transistor is electrically connected to the first electrode of the light-emitting element, a gate electrode of the drive transistor is electrically connected to a second electrode of the data writing transistor and a first terminal of the storage capacitor, a first electrode of the data writing transistor is configured to receive the display data voltage, a gate electrode of the data writing transistor is configured to receive the scan signal, and a second terminal of the storage capacitor is electrically connected to the power supply.

5. The display panel according to claim 1, wherein the detection circuit comprises a first sub-circuit and a second sub-circuit, a first terminal of the first sub-circuit, as the detection signal terminal, is connected to the first electrode of the light-emitting element, a second terminal of the first sub-circuit is connected to the second sub-circuit, a control terminal of the first sub-circuit is configured to receive a switch control signal, and the first sub-circuit is configured to disconnect or connect the second sub-circuit and the first electrode of the light-emitting element under control of the switch control signal; and the second sub-circuit is configured to detect the electrical parameter.

6. The display panel according to claim 5, wherein the control voltage terminal is further connected to the control terminal of the first sub-circuit to transmit the variable voltage to the control terminal of the first sub-circuit, and the variable voltage serves as the switch control signal.

7. The display panel according to claim 5, wherein the first sub-circuit comprises a switch element, the first terminal of the first sub-circuit serves as an input terminal of the switch element, the second terminal of the first sub-circuit serves as an output terminal of the switch element, and the control terminal of the first sub-circuit serves as a control terminal of the switch element.

8. The display panel according to claim 5, wherein the detection circuit further comprises a control sub-circuit, an output terminal of the control sub-circuit serves as the control voltage terminal, and the control sub-circuit is configured to generate and output the variable voltage.

9. The display panel according to claim 1, further comprising an array substrate and a drive chip, wherein the drive chip is bonded to the array substrate through a flexible circuit board, the array substrate comprises the sub-pixel, and the drive chip comprises the detection circuit.

10. The display panel according to claim 1, wherein the compensation circuit comprises a calculation module and a first storage sub-circuit, the calculation module is configured to:

acquire a plurality of detection data voltages, which are in one-to-one correspondence to the plurality of electrical parameters, for the sub-pixel, calculate a characteristic parameter of the pixel circuit according to the plurality of electrical parameters and the plurality of detection data voltages, and calculate the compensated data voltage based on the initial data voltage according to the characteristic parameter; and the first storage sub-circuit is configured to store the characteristic parameter.

11. The display panel according to claim 1, wherein the compensation circuit comprises a calculation module and a first storage sub-circuit, the calculation module is configured to:

acquire a plurality of detection data voltages, which are in one-to-one correspondence to the plurality of electrical parameters, for the sub-pixel, calculate a characteristic parameter of the pixel circuit according to the plurality of electrical parameters and the plurality of detection data voltages, calculate to obtain a plurality of standard compensation data voltages, which are in one-to-one correspondence to all gray scale levels of the sub-pixel, according to the characteristic parameter, and acquire the compensated data voltage corresponding to the initial data voltage based on the plurality of standard compensation data voltages; and the first storage sub-circuit is configured to store the plurality of standard compensation data voltages.

12. The display panel according to claim 1, wherein the electrical parameter comprises a current at the first electrode of the light-emitting element.

13. A display device, comprising the display panel according to claim 1.

14. A display panel, comprising a sub-pixel and a detection circuit, and a compensation circuit, wherein the sub-pixel comprises a pixel circuit and a light-emitting element, the pixel circuit comprises a drive transistor, a data writing transistor, and a storage capacitor, the detection circuit is configured to detect a plurality of electrical parameters at the first electrode of the light-emitting element, the detection circuit comprises a first sub-circuit and a second sub-circuit, and the first sub-circuit comprises a switch element;

a first electrode of the drive transistor is electrically connected to a power supply, a second electrode of the drive transistor is electrically connected to a first electrode of the light-emitting element, a gate electrode of the drive transistor is electrically connected to a second electrode of the data writing transistor and a first terminal of the storage capacitor, a first electrode of the data writing transistor is configured to receive a display data voltage, a gate electrode of the data writing transistor is configured to receive a scan signal, and a second terminal of the storage capacitor is electrically connected to the power supply;

a second electrode of the light-emitting element is configured to receive a variable voltage, and the variable voltage comprises a first sub-voltage signal;

an input terminal of the switch element is connected to the first electrode of the light-emitting element, an output terminal of the switch element is connected to the second sub-circuit, a control terminal of the switch element is configured to receive the variable voltage, and the switch element is turned on in a case where the first sub-voltage signal is applied to the control terminal of the switch element; and the second sub-circuit is configured to detect an electrical parameter at the first electrode of the light-emitting element in a case where the first sub-voltage signal is applied to the second electrode of the light-emitting element;

the compensation circuit is configured to calculate to obtain a compensated data voltage based on an initial data voltage according to the plurality of electrical parameters, and the compensated data voltage serves as a display data voltage for the sub-pixel to perform a display operation.

15. A detection method applied to a display panel, wherein the display panel comprises a sub-pixel, a detection circuit, and a compensation circuit, the sub-pixel comprises a pixel circuit and a light-emitting element, and the pixel circuit is connected to the light-emitting element and is configured to drive the light-emitting element to emit light;

the detection circuit comprises a detection signal terminal and a control voltage terminal, a first electrode of the light-emitting element is connected to the detection signal terminal, and a second electrode of the light-emitting element is connected to the control voltage terminal; and the detection circuit is configured to output a variable voltage, through the control voltage terminal, to the second electrode of the light-emitting element, the variable voltage comprises a first sub-voltage signal, and the detection circuit is further configured to detect an electrical parameter at the first electrode of the light-emitting element in a case where the first sub-voltage signal is applied to the second electrode of the light-emitting element, the detection circuit is further configured to detect a plurality of electrical parameters at the first electrode of the light-emitting element; and the compensation circuit is configured to calculate to obtain a compensated data voltage based on an initial data voltage according to the plurality of electrical parameters, and the compensated data voltage serves as a display data voltage for the sub-pixel to perform a display operation, the detection method comprises:

controlling a state of the light-emitting element by the first sub-voltage signal of the variable voltage and detecting a plurality of electrical parameters of the first electrode of the light-emitting element.

16. The detection method according to claim 15, wherein controlling the state of the light-emitting element by the first sub-voltage signal of the variable voltage and detecting the plurality of electrical parameters of the first electrode of the light-emitting element comprises:

controlling the light-emitting element to be in a turn-off state by the first sub-voltage signal to detect the plurality of electrical parameters acquired by the first electrode of the light-emitting element.

17. The detection method according to claim 15, wherein the pixel circuit comprises a drive sub-circuit, and the detection method further comprises:

acquiring a plurality of detection data voltages, which are in one-to-one correspondence to the plurality of electrical parameters, for the sub-pixel; and calculating to obtain a characteristic parameter of the drive sub-circuit according to the plurality of electrical parameters and the plurality of detection data voltages.

18. The detection method according to claim 17, further comprising:

calculating to obtain a plurality of standard compensation data voltages, which are in one-to-one correspondence to all gray scale levels of the sub-pixel, according to the characteristic parameter.

19. The detection method according to claim 18, wherein calculating to obtain a plurality of standard compensation data voltages, which are in one-to-one correspondence to all gray scale levels of the sub-pixel, according to the characteristic parameter comprises:

selecting a plurality of reference gray scale levels;

calculating a plurality of reference light-emitting currents, which are in one-to-one correspondence to the plurality of reference gray scale levels, based on a corresponding relation between a current of the light-emitting element and a brightness of the light-emitting element;

calculating a plurality of reference compensation data voltages, which are in one-to-one correspondence to the plurality of reference gray scale levels, according to the characteristic parameter and the plurality of reference light-emitting currents; and calculating a plurality of standard compensation data voltages, which are in one-to-one correspondence to the all gray scale levels, according to the plurality of reference compensation data voltages.

* * * * *